US011098560B2

(12) United States Patent
Glaser

(10) Patent No.: US 11,098,560 B2
(45) Date of Patent: Aug. 24, 2021

(54) INFLATABLE DEFLECTOR FOR REENTRY ACCESS INTO A LATERAL WELLBORE

(71) Applicant: Halliburton Energy Services, Inc., Houston, TX (US)

(72) Inventor: Mark C. Glaser, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/080,894

(22) PCT Filed: Nov. 13, 2017

(86) PCT No.: PCT/US2017/061328

§ 371 (c)(1),
(2) Date: Aug. 29, 2018

(87) PCT Pub. No.: WO2019/094048

PCT Pub. Date: May 16, 2019

(65) Prior Publication Data

US 2021/0102443 A1 Apr. 8, 2021

(51) Int. Cl.

| | |
|---|---|
| ***E21B 41/00*** | (2006.01) |
| ***E21B 17/20*** | (2006.01) |
| ***E21B 23/06*** | (2006.01) |
| ***E21B 33/127*** | (2006.01) |
| ***E21B 43/26*** | (2006.01) |

(52) U.S. Cl.

CPC ..... *E21B 41/0035* (2013.01); *E21B 17/20* (2013.01); *E21B 23/06* (2013.01); *E21B 33/127* (2013.01); *E21B 43/26* (2013.01)

(58) Field of Classification Search

CPC ..... E21B 41/0035; E21B 43/26; E21B 23/06; E21B 33/127; E21B 17/20

See application file for complete search history.

(56) References Cited

U.S. PATENT DOCUMENTS

| | | | | |
|---|---|---|---|---|
| 2,211,803 A | | 8/1940 | Warburton | |
| 5,318,121 A | * | 6/1994 | Brockman | E21B 7/061 166/313 |
| 5,415,238 A | * | 5/1995 | Nice | E21B 41/0035 166/381 |

(Continued)

OTHER PUBLICATIONS

International Search Report and the Written Opinion of the International Search Authority, or the Declaration, dated Jan. 11, 2018, PCT/US2017/061328, 21 pages, ISA/KR.

*Primary Examiner* — James G Sayre
(74) *Attorney, Agent, or Firm* — Haynes and Boone, LLP

(57) ABSTRACT

A tool, system, and method for reentry access into a lateral wellbore. The tool, utilized in the system and the method, can include a body with an internal flow passage, an inflatable bladder disposed along an exterior portion of the body, and a flow restrictor that can partially restrict fluid flow through the internal flow passage and create a pressure differential across the tool when fluid pressure rises at an inlet of the internal flow passage. The pressure differential can cause inflation of the inflatable bladder and a surface of the inflatable bladder can be extended radially outward from the body in response to the inflation, where the extended surface can push the tool away from a wall of a main wellbore toward an opposite wall of the main wellbore and divert the tool into a lateral wellbore.

21 Claims, 15 Drawing Sheets

(56) References Cited

U.S. PATENT DOCUMENTS

| | | | | |
|---|---|---|---|---|
| 5,520,252 | A * | 5/1996 | McNair | E21B 7/061 166/313 |
| 6,527,067 | B1 | 3/2003 | Ravensbergen et al. | |
| 2001/0040054 | A1* | 11/2001 | Haugen | E21B 43/103 175/61 |
| 2016/0245046 | A1* | 8/2016 | Butler | E21B 17/006 |
| 2016/0273312 | A1 | 9/2016 | Steele et al. | |
| 2016/0340994 | A1* | 11/2016 | Ferguson | E21B 23/14 |

* cited by examiner

INFLATABLE DEFLECTOR FOR REENTRY ACCESS INTO A LATERAL WELLBORE

PRIORITY

The present application is a U.S. National Stage patent application of International Patent Application No. PCT/US2017/061328, filed on Nov. 13, 2017, the benefit of which is claimed and the disclosure of which is incorporated herein by reference in its entirety.

TECHNICAL FIELD

The present disclosure generally relates to oilfield equipment and, in particular, to downhole tools, drilling and related systems and techniques for deflecting tubing strings and downhole tools into lateral wellbores. More particularly still, the present disclosure relates to methods and systems for deflecting tubing strings and downhole tools into lateral wellbores by inflating a bladder.

BACKGROUND

In order to produce formation fluids from an earthen formation, wellbores can be drilled into the earthen formation to a desired depth for producing the formation fluids. After drilling a wellbore, casing strings can be installed in the wellbore providing stabilization to the wellbore and keeping the sides of the wellbore from caving in on themselves. Lateral wellbores can then be drilled from a main wellbore into various regions of the earthen formation. After drilling these laterals, multiple operations are normally performed to "complete" the lateral, such as installing casing, perforating the lateral wellbore at various intervals, fracturing the intervals through the perforations, installing a completion string, producing fluid from the lateral, etc. These operations can require several reentry operations which can require steering the end of a tubing string (e.g. work string, injection string, production string, liner, etc.) into the lateral from the main wellbore. A deflector can be used to steer (or deflect) the tubing string end from the main wellbore into the lateral wellbore. The deflector is normally installed in the main wellbore just below the intersection of the main wellbore and the lateral wellbore. An inclined surface of the deflector urges the end of the tubing string away from the main wellbore and into the lateral wellbore. Therefore, as the tubing string is lowered further into the main wellbore, the end of the tubing string is deflected into the lateral wellbore by the deflector. However, installing the deflector for enabling reentry into the lateral wellbore can require a separate operation that can consume valuable well site time.

A bent sub can also be used to steer the tubing string into a lateral wellbore. A bent sub is a pipe segment that has been bent at an angle somewhere along the pipe segment. With the bent sub assembled near the end of the tubing string, the bent sub can angle the end of the tubing string into the lateral, thereby permitting reentry access of the tubing string into the lateral wellbore. However, there are disadvantages of using a bent sub for reentry into the lateral wellbore. Additional clearance is needed in the main and lateral wellbores because of the bend in the pipe segment of the bent sub. The end of the tubing string can be sliding against one wall of the wellbore, while a knee of the bend sub is sliding along an opposite wall 15 of the wellbore (or other tubing string, such as casing). Therefore, either the wellbores have a greater diameter or the bend subs have a reduced diameter to allow passage of the bent sub through the wellbores. The reduced diameter can mean that less fluid can flow through the tubing string for injection/production operations. The reduced diameter can also interfere with using standard frac balls, bridge plugs, and perforating guns.

Therefore, it will be readily appreciated that improvements in the arts of enabling reentry access to a lateral wellbore are continually needed.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
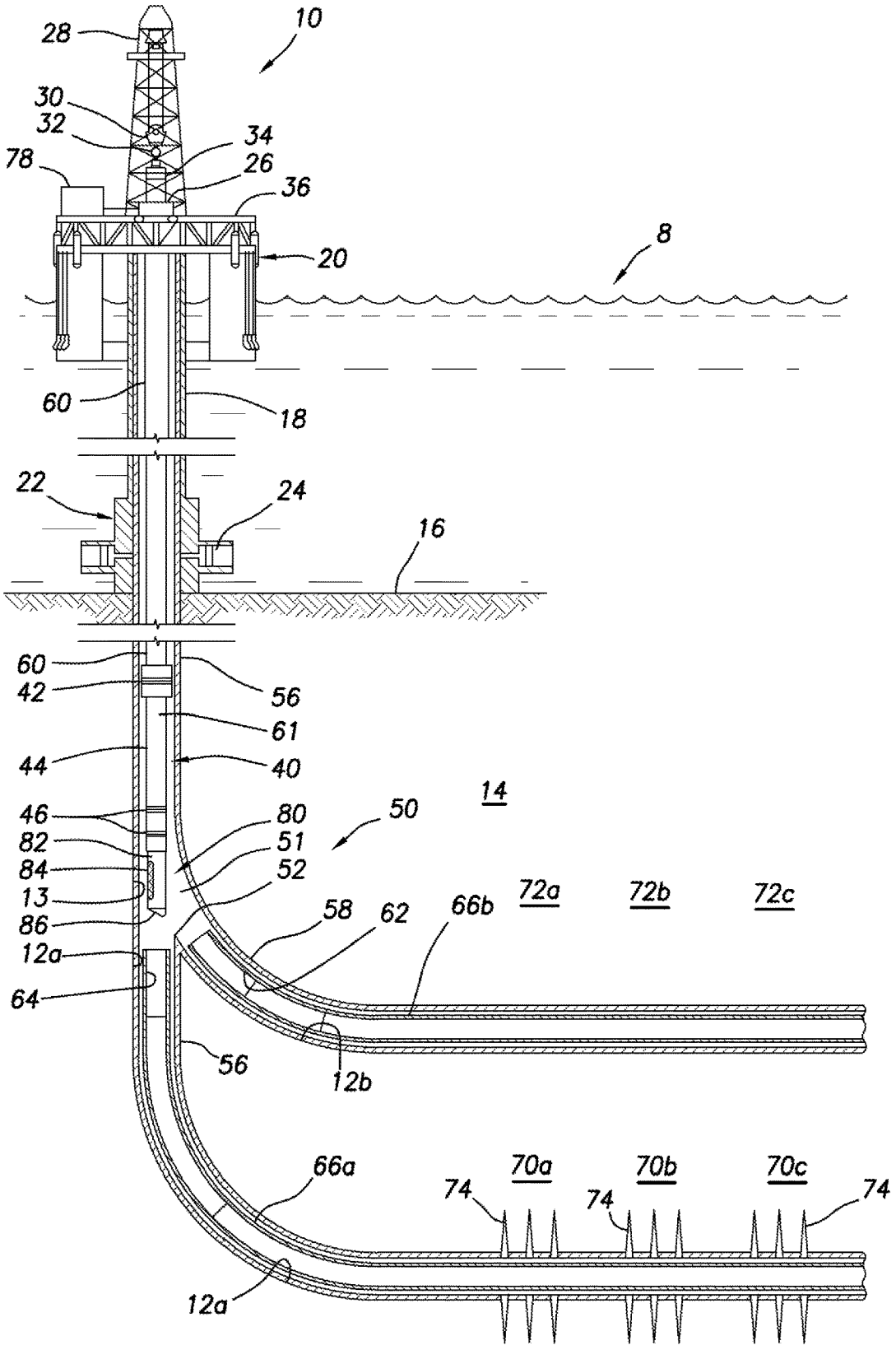
FIG. 1 is a representative partial cross-sectional view of a marine-based well system with an inflatable deflector tool attached to an end of a tubing string, according to one or more example embodiments, with a completion string in each a main wellbore and a lateral wellbore.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a horizontal wellbore or a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a Figure may depict an offshore operation, it should be understood by those skilled in the art that the method and/or system according to the present disclosure is equally well suited for use in onshore operations and vice-versa. Further, unless otherwise noted, even though a Figure may depict a cased hole, it should be understood by those skilled in the art that the method and/or system according to the present disclosure is equally well suited for use in open hole operations.

As used herein, the words "comprise," "have," "include," and all grammatical variations thereof are each intended to have an open, non-limiting meaning that does not exclude additional elements or operations. While compositions and methods are described in terms of "comprising," "containing," or "including" various components or operations, the compositions and methods also can "consist essentially of" or "consist of" the various components and operations. It should also be understood that, as used herein, "first," "second," and "third," are assigned arbitrarily and are merely intended to differentiate between two or more objects, etc., as the case may be, and does not indicate any sequence. Furthermore, it is to be understood that the mere use of the word "first" does not require that there be any "second," and the mere use of the word "second" does not require that there be any "first" or "third," etc.

As used herein, "lateral" wellbore refers to a wellbore drilled through a wall of a primary wellbore and extending through the earth formation. This can include drilling a lateral wellbore from a main wellbore, as well as drilling a lateral wellbore from another lateral wellbore (which is sometimes referred to as a "twig" or "branch" wellbore). As used herein, "main wellbore" refers to a wellbore from which a lateral is drilled. This can include the initial wellbore of the wellbore system 10 from which a lateral wellbore is drilled, or a lateral wellbore from which another lateral wellbore is drilled (such as with a twig or branch wellbore).

The terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

Generally, this disclosure provides tools, systems, and methods for reentry access into a lateral wellbore. A tool, utilized in the systems and methods, can include a body with an internal flow passage, an inflatable bladder disposed along an exterior portion of the body, and a flow restrictor that can partially restrict fluid flow through the internal flow passage. The flow restrictor can create a pressure differential across the tool when fluid pressure rises at an inlet of the internal flow passage. The pressure differential can cause inflation of the inflatable bladder and a surface of the inflatable bladder can be extended radially outward from the body in response to the inflation. The extended surface can push the tool away from a wall of a main wellbore toward an opposite wall of the main wellbore and divert the tool into a lateral wellbore.

Referring to FIG. 1, a partial cross-sectional view of a marine-based well system 8 is shown. This is but one example of a well system 8 that can utilize the principles of the present disclosure. It should be understood that more or fewer components can be used in the well system 8. A semi-submersible platform 36 can be positioned over a submerged earthen formation 14 located below a sea floor 16. A subsea conduit 18 can extend from a deck 20 of the platform 36 to a subsea wellhead 22, including blowout preventers 24. The platform 36 can have a hoisting apparatus 26, a derrick 28, a travel block 30, a hook 32, and a swivel 34 for raising and lowering pipe strings, such as a substantially tubular, axially extending tubing string 60.

A main wellbore 12*a* can extend through the earthen formation 14 and can have a casing string 56 cemented therein. A lateral wellbore 12*b* can extend into the earthen formation 14 from the main wellbore 12*a* and can have another casing string 58 cemented therein. Lower completion strings (or assemblies) 66*a*, 66*b* can be installed in the main wellbore 12*a* and the lateral wellbore 12*b*, respectively, from an offshore oil and/or gas platform 10. An inflatable deflector tool 80 can be used to divert a distal end of a tubing string 60 into the lateral wellbore 12*b*. Therefore, the inflatable deflector tool 80 can be used to deflect tubing strings as well as various downhole equipment (such as perforating equipment, screen assemblies, bridge plugs, packers, pumps, logging tools, sensors, telemetry devices, flow control devices, orientation devices, liner strings, etc.) into the lateral wellbore and branch (or twig) wellbores. The inflatable deflector tool 80 can also be used to deliver the lower completion string 66*b* into the lateral wellbore 12*b*, and then use another inflatable deflector tool 80 to divert a tubing string and/or other downhole equipment into the lateral wellbore 12*b* to engage and/or couple to the completion string 66*b*.

FIGS. 1-5 illustrate various operations in a completion process for completing the main and lateral wellbores 12*a*, 12*b*. However, it should be understood that these are merely examples of how the inflatable deflector tool 80 can be used to facilitate reentry into the lateral wellbore 12*b* after the lateral wellbore 12*b* has been drilled. These examples are provided for purposes of discussion and should not be used to limit that application of the inflatable deflector tool 80 in other configurations and operations. FIG. 1 shows a lower completion string 66*a* installed in a lower portion of the main wellbore 12*a*, and a lower completion string 66*b* installed in a lower portion of the lateral wellbore 12*b*. The lower portion of the main wellbore 12*a* has been perforated, forming perforations 74 at each of the desired wellbore intervals 70*a-c*. Perforation operations have not yet been performed at the intervals 72*a-c* of the lateral wellbore 12*b*.

The inflatable deflector tool 80 can be attached to a distal end of the tubing string 60 via a straddle structure 40. It should be understood that various other downhole tools, other than the straddle structure 40 can be installed in the tubing string 60, in keeping with the principles of the current disclosure. In this example, the straddle structure 40 can include a body 44 with a retrievable packer 42 at one end of the body 44 and a plurality of seals 46 at an opposite end of the body 44. The straddle structure 40 can be used to straddle the intersection 50 where the lateral wellbore 12*b* intersects the main wellbore 12*a*. The straddle structure 40 can be installed between the upper portion of the main wellbore 12*a* and the lower portion of the main wellbore 12*a* (where the upper portion is above the intersection 50, and the lower portion is below the intersection 50), which can prevent fluid communication with the lateral wellbore 12*b*. The straddle structure 40 can alternatively be installed between the upper portion of the main wellbore 12*a* and the lateral wellbore 12*b*, which can prevent fluid communication with the lower portion of the main wellbore 12*a*. Selectively isolating the window 51 and these lower wellbore sections from each other can be beneficial, maybe even necessary, when fracturing the various intervals 70*a-c*, 72*a-c*.

The inflatable deflector tool 80 can include a body 82, an inflatable bladder 84 attached to an exterior of the body 82, and a nose 86. The inflatable bladder 84 can be positioned on one side of the body, such that when the bladder 84 is extended, the bladder 84 will push the tool 80 away from the main wellbore wall 13 toward the opposite wall 15 of the main wellbore 12*a* (which is preferably toward the lateral wellbore 12*b*). In FIG. 1, the bladder 84 is not inflated, therefore, extending the tubing string 60 further into the main wellbore 12*a* will cause the inflation deflector tool 80 to be inserted into an end of the lower completion string 66*a*. This lower completion string 66*a* can have a polished bore receptacle (PBR) 64, through which the inflatable deflector tool 80 may pass.

Figure 2:
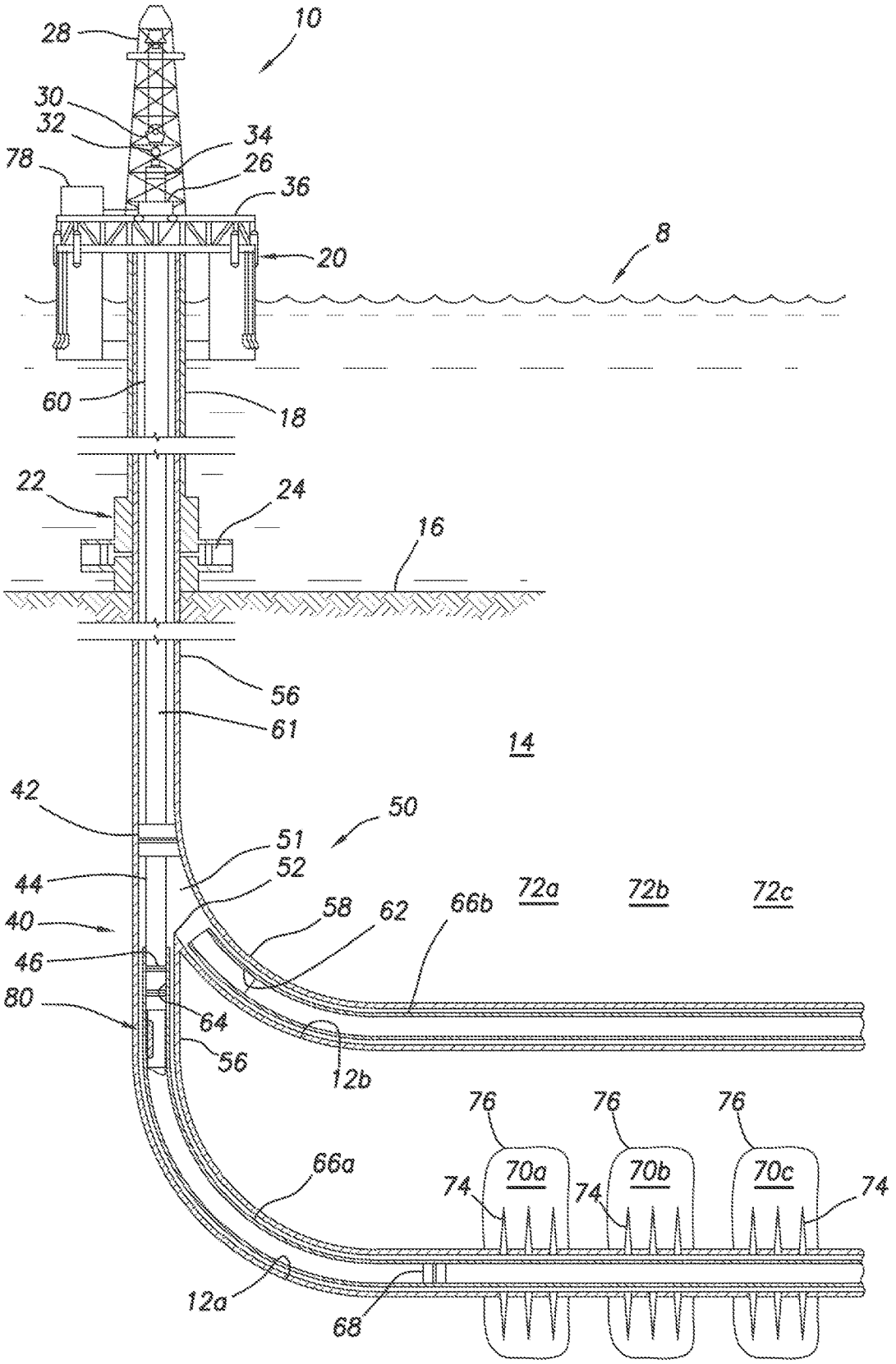
FIG. 2 is representative partial cross-sectional view of the marine-based well system with the end of the tubing string extended into the main wellbore's lower completion string, according to one or more example embodiments.

As shown in FIG. 2, the tubing string 60 has been extended into the main wellbore 12*a* such that the inflatable deflector tool 80 is received within the lower completion string 66*a* far enough to allow the seals 46 on the end of the straddle structure 40 to sealingly engage with the PBR 64. The retrievable packer 42 can be set to secure the straddle structure 40 in the main wellbore 12*a* straddling the window 51. Once the seals 46 sealingly engage the PBR 64 and the retrievable packer 42 is set, fracturing fluid can be delivered to the completion string 66*a* to form fractures 76 through perforations 74, without risk of exposing the window 51 or the lateral wellbore 12*b* to the fracturing fluid flow and pressures.

Unlike a bent sub, the body of the inflatable deflector tool 80 is straight thereby allowing a larger constant inner diameter ID to be maintained. The ID of the inflatable deflector tool 80 can equal to the ID of the tubing string 60, thereby allowing standard objects (such as standard frac balls, bridge plugs, and perforating guns) to be delivered through the inflatable deflector tool 80 without hanging up. As can be seen, after the fracturing operation is complete, a standard bridge plug 68 can be installed in the lower completion string 66*a* above the fractured intervals 70*a-c*. A minimum ID of a flow passage 61 that extends through the tubing string 60, the straddle structure 40 (if used), and the inflatable deflector tool 80 can be larger than a minimum ID for the flow passage 61 for a system using a bent sub, since the bend in the sub requires extra clearance to travel through the wellbores 12*a*, 12*b*. Therefore, the current inflatable deflector tool 80 can be an improvement over systems that utilize a bent sub approach. Also, using the current inflatable deflector tool 80 can be an improvement over systems that utilize inclined deflectors to direct tubing strings and equipment into a lateral wellbore, since fewer trips into the main wellbore may be required by using the inflatable deflector tool 80.

Figure 3:
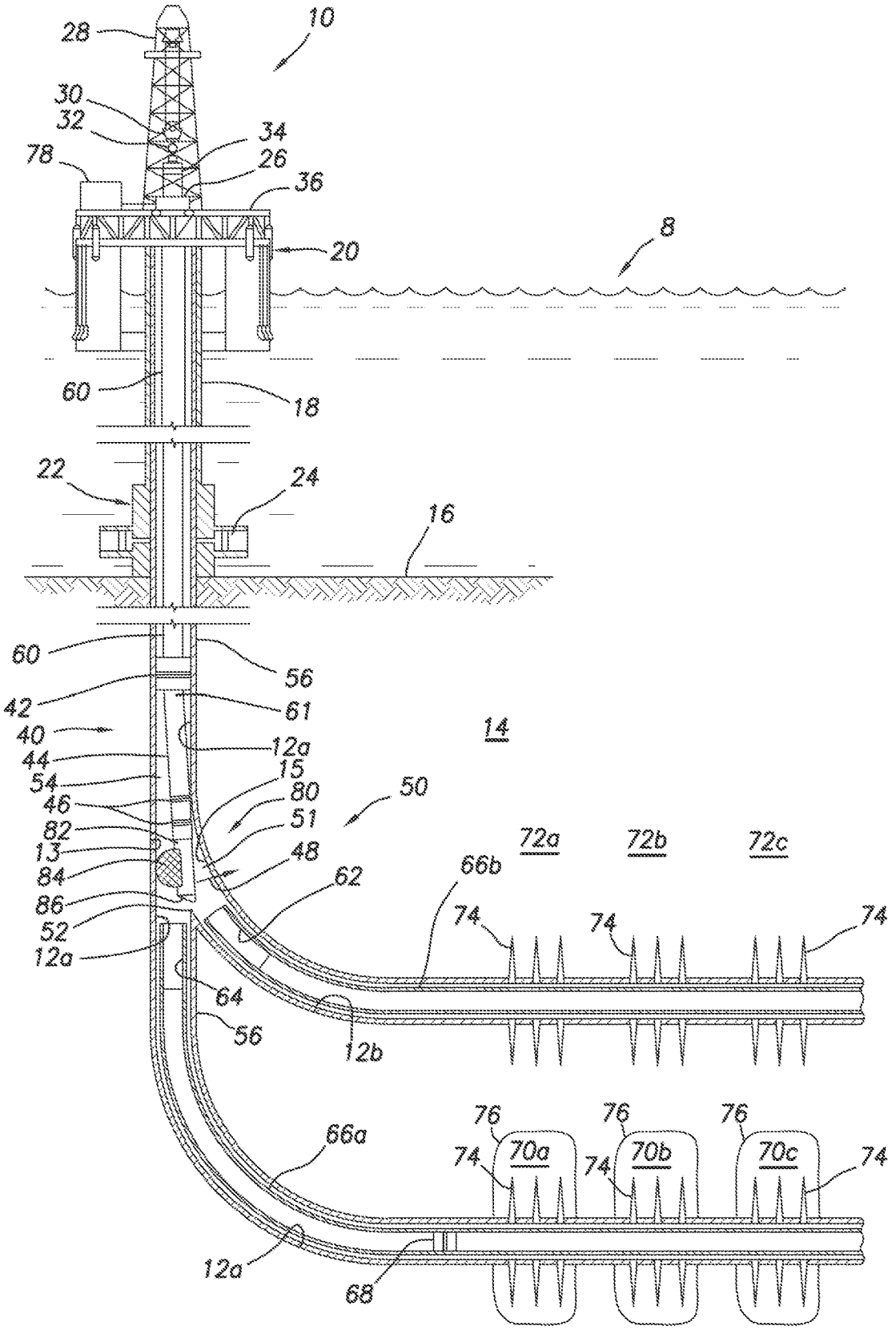
FIG. 3 is representative partial cross-sectional view of the marine-based well system with the inflatable deflector tool inflated, thereby steering the tubing string into the lateral wellbore, according to one or more example embodiments.

FIG. 3 shows the retrievable packer 42 unset, and the tubing string 60 pulled back from the intersection 50. In preparation for insertion of the inflatable deflector tool 80 and the straddle structure 40 into the lateral wellbore 12*b*, the inflatable bladder 84 is inflated, thereby displacing the inflatable deflector tool 80 away from the main wellbore wall 13 (see motion arrow 48) along with the end of the straddle structure 40 (or possibly the tubing string 60 if the straddle structure 40 is not used). The inflatable bladder 84 can be expanded to cause an inclined, sloped, or rounded portion of a nose 86 of the inflatable deflector tool 80 to be aligned with the bottom 52 of the window 51. Therefore, with the bladder 84 still inflated, as the tubing string 60 is again extended into the main wellbore 12*a*, the inclined, sloped, or rounded surface of the nose 86 can cause the inflatable deflector tool 80 to be further deflected into the lateral wellbore 12*b* after the nose 86 has engaged the bottom 52 of the window 51.

Figure 4:
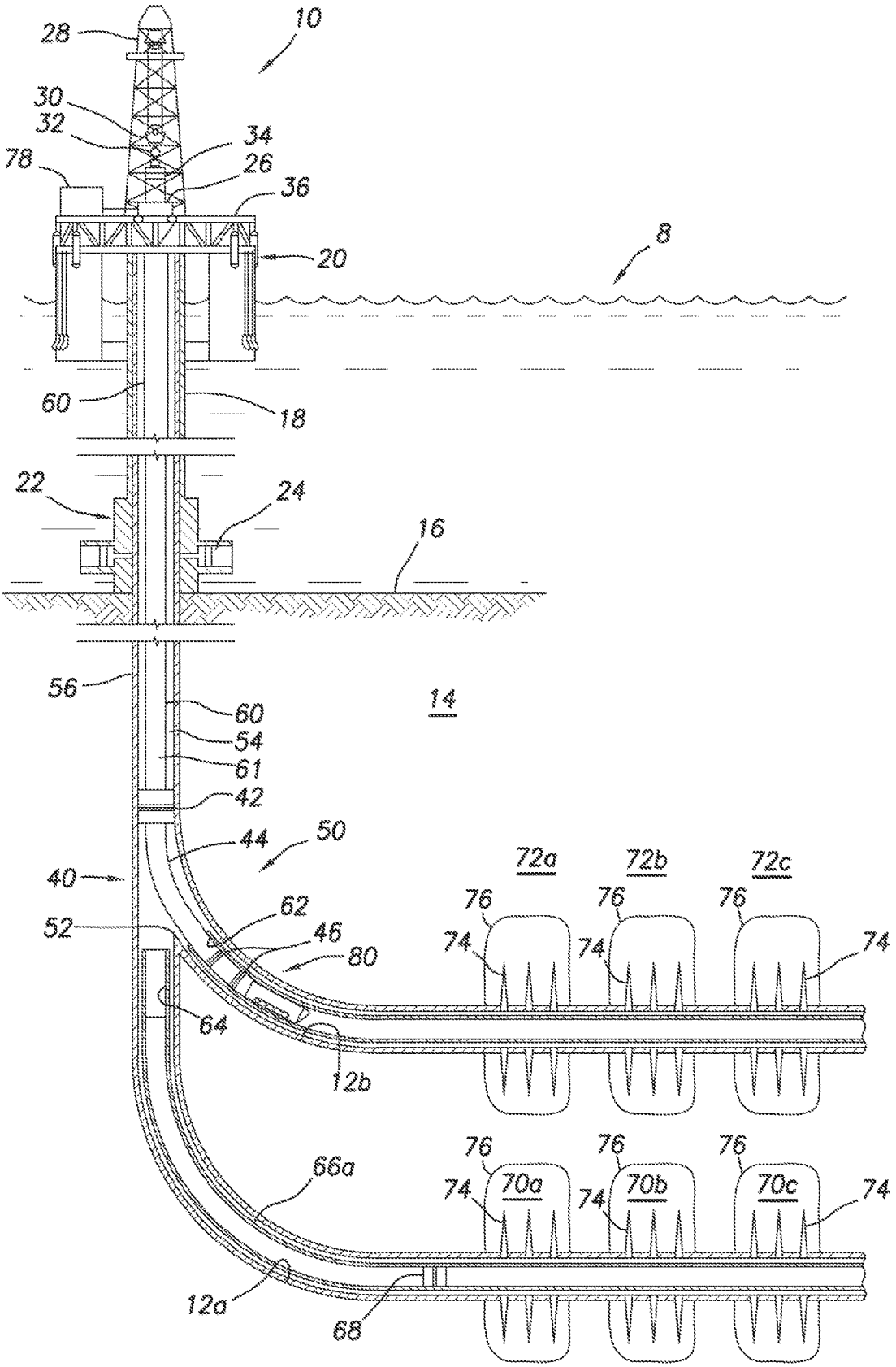
FIG. 4 is representative partial cross-sectional view of the marine-based well system with the end of the tubing string extended into the lateral wellbore's lower completion string, according to one or more example embodiments.

FIG. 4 shows the inflatable deflector tool 80 extended into the lower completion string 66*b*, past the PBR 62, with the seals 46 at the end of the straddle structure 40 engaging the PBR 62. The retrievable packer 42 can again be set to seal off the annulus 54. As can be seen in FIG. 4, the straddle structure 40, via the packer 42 and the seals 46 can prevent exposure of the window 51 and the lower portion of the main wellbore 12*a* to the fluid flow and pressures in the internal flow passage 61. With the window 51 isolated, perforating and fracturing processes can begin in the lateral wellbore 12*b*. A perforating gun (not shown) can be lowered to each interval 72*a-c* to form perforations 74 at each interval 72*a-c*. Then fracturing fluid can be pumped through the perforations 74 to form fractures 76. Additionally, treatment fluids can be pumped into the fractures and perforations to prepare the lateral wellbore 12*b* for production operations. Production fluids can be carried to the surface through the configuration shown in FIG. 4, but additional completion equipment can also be installed in the wellbore 12*a* at the intersection 50 instead of the straddle structure 40 to facilitate production or injection operations for one or both of the wellbores 12*a*, 12*b*.

Figure 5:
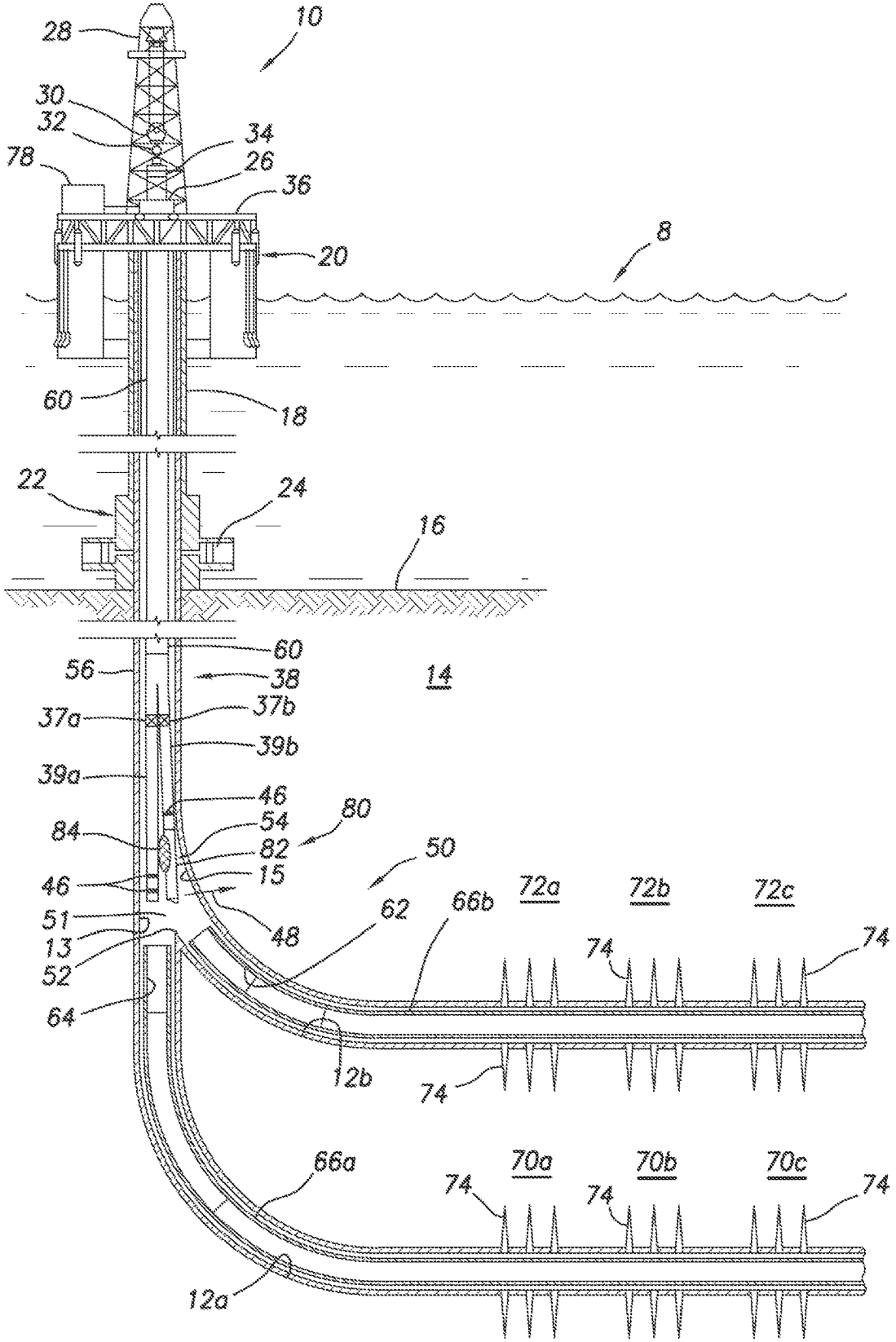
FIG. 5 is representative partial cross-sectional view of the marine-based well system with a unitary junction assembly being run in the main wellbore, the inflatable deflector tool used to separate the primary and lateral legs of the junction and steer the primary and lateral legs into the main and lateral wellbores, respectively, according to one or more example embodiments.

FIG. 5 shows another configuration of a well system 8 that can benefit from the inflatable deflector tool 80 of the current disclosure. As can be seen, perforations 74 have been formed at the intervals 70*a-c* in the lower portion of the main wellbore 12*a* and at the intervals 72*a-c* in the lateral wellbore 12*b*. Fracturing at the intervals 70*a-c* and 72*a-c* via perforations 74 may be desired. The well system 8 can include lower completion strings 66*a* and 66*b*, a tubing string 60 with a unitary junction assembly 38 installed at a distal end of the tubing string 60, and an inflatable deflector tool 80. The unitary junction assembly 38 can include a primary leg 39*a* and a lateral leg 39*b*, with respective flow control devices 37*a* and 37*b*. Seals 46 can be disposed on an exterior of a distal end of the primary and lateral legs 39*a*, 39*b*. As the tubing string 60 is lowered into the main wellbore 12*a*, the inflatable deflector tool 80 approaches the intersection 50. When the bladder 84 is inflated, it can push against the primary leg 39*a*, which can push against the wellbore wall 13. Therefore, the inflation of the bladder 84 can at least indirectly push against the wall 13 and cause the lateral leg 39*b* and the inflatable deflector tool 80 to move (or displace) away from the wall 13 toward the opposite wall 15 of the main wellbore, directing the lateral leg 39*b* into the lateral wellbore 12*b*. An inclined, sloped, or rounded surface of the inflatable deflector tool 80 can engage the bottom 52 of the window 51 and further urge the lateral leg 39*b* into the lateral wellbore 12*b*. The tubing string 60 can be extended further into the main wellbore 12*a* such that the seals 46 on the primary leg 39*a* can sealingly engage with the PBR 64 and the seals 46 on the lateral leg 39*b* can sealingly engage with the PBR 62. Once the PBRs are engaged with the respective seals 46, then the flow control devices 37*a*, 37*b* can be individually controlled to flow fracturing fluid to the desired intervals 70*a-c*, 72*a-c*. It should be understood that the placement of the flow control devices shown in FIG. 5 is but one possible configuration. For example, the flow control devices 37*a*, 37*b* can be installed in the respective lower completion strings 66*a*, 66*b*.

Figure 6A:
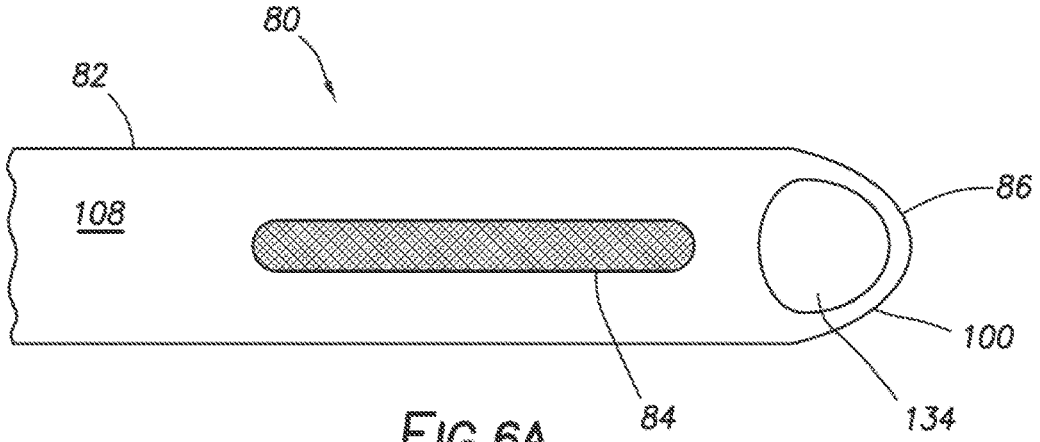
FIGS. 6A-C are representative views of an inflatable deflector tool, according to one or more example embodiments.
Figure 6B:
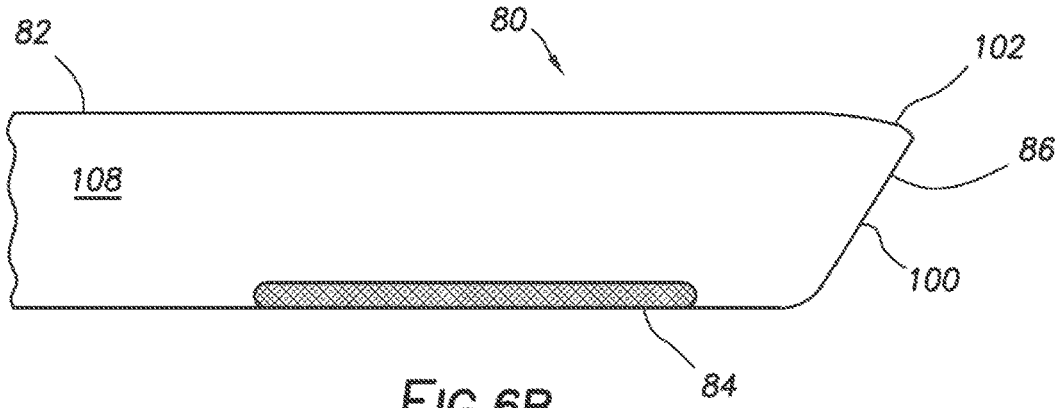
Figure 6C:
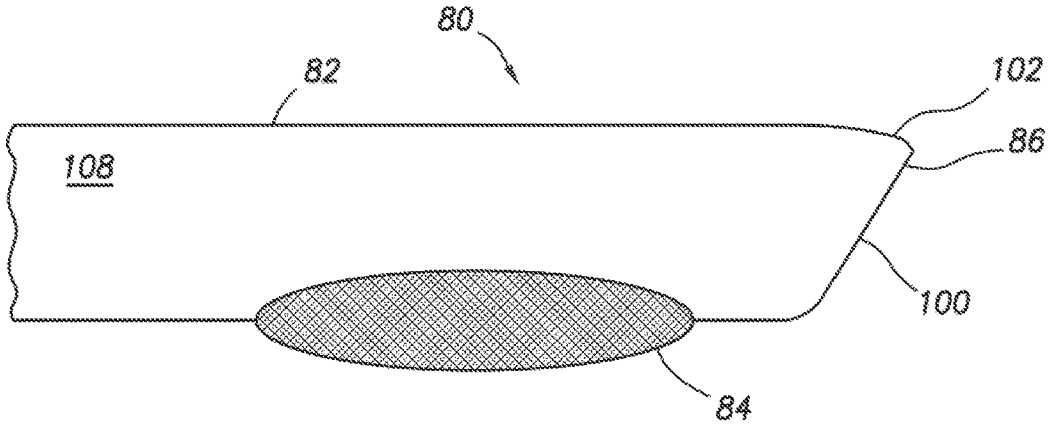

FIGS. 6A-C show various representative views of an example embodiment of the inflatable deflector tool 80. FIG. 6A is a representative bottom view of the inflatable deflector tool 80, with the inflatable bladder 84 positioned along a bottom of the exterior surface 108 of the body 82. The bladder 84 can be many different shapes than the elongated shape shown in FIG. 6A, as long as the shape necessarily allows the bladder 84, when inflated, to urge the inflatable deflector tool 80 into the lateral wellbore 12*b* and when deflated minimizes an exterior profile of the inflatable deflector tool 80, such that the maximum outer diameter OD of the inflatable deflector tool 80 is substantially the same as if not smaller than an OD of the tubing string 60. The body 82 can have a nose 86 formed as a "lipstick" shape, with a tapered surface 102 and an inclined surface 100, with an outlet 134 formed in the inclined surface 100. The nose 86 can also be formed as other shapes, such as conical, spherical, etc., as long as the shape will support urging the inflatable deflector tool 80 into the lateral wellbore 12*b* when the shape engages the bottom 52 of the window 51. It should be understood that multiple inflatable bladders 84 can be attached to the exterior surface 108 of the body 82 to provide an increased radial expansion force. FIG. 6B shows the inflatable bladder 84 positioned on and/or in the exterior surface 108 of the body 82 opposite the taper 102 of the lipstick-shaped nose 86. This position can minimize the inflation of the bladder 84 that is needed to deflect the inflatable deflector tool 80 away from the wellbore wall 13 enough to cause the inclined surface 100 to engage the bottom 52 of the window 51. Therefore, the side of the inflatable deflector tool 80 that is opposite the bladder 84 should be oriented toward the window 51, and the bladder 84 should be oriented toward the wall 13, which is opposite the window 51. When the bladder 84 is inflated, as in FIG. 6C, the inflatable deflector tool 80 can be pushed away from the wall 13 toward the window 51 and the lateral wellbore 12*b*.

Figure 7:
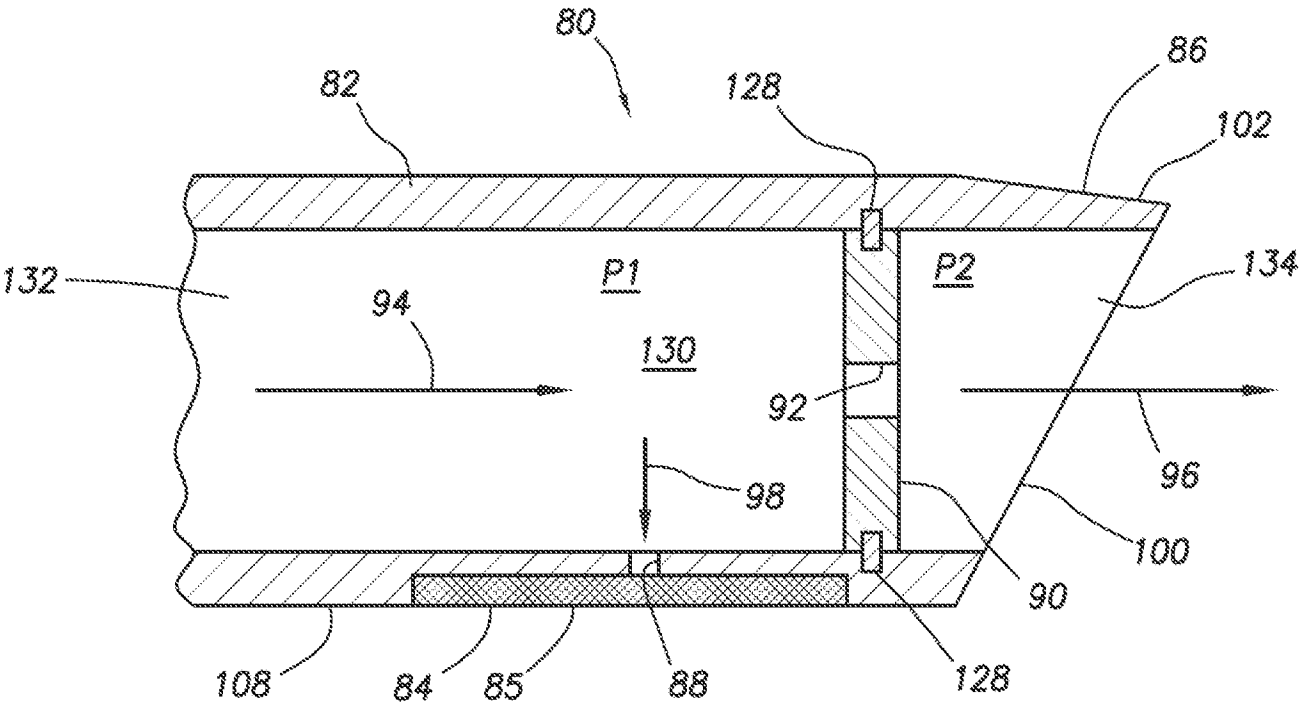
FIG. 7 is a representative partial cross-sectional view of the inflatable deflector tool of FIGS. 6A-C.

FIG. 7 shows a representative partial cross-sectional view of an embodiment of the inflatable deflector tool 80. The body 82 is substantially cylindrical with a lipstick-shaped nose 86. The "lipstick-shape" refers to the tapered surface 102 intersecting the inclined surface 100, which is generally circular in shape. The body 82 includes an internal flow passage 130 that is in fluid communication with the internal flow passage 61 of the tubing string 60 when the inflatable deflector tool 80 is attached to the distal end of the tubing string. A flow restrictor 90 can be positioned in the internal flow passage 130 to cause a pressure differential across the inflatable deflector tool 80 when pressure P1 at the inlet 132 of the internal flow passage 130 is increased. The flow restrictor 90 is shown to be a disk with a port 92 formed at its center. However, any flow restrictor can be used as long as the flow restrictor can produce a desired pressure differential across the inflatable deflector tool 80 and be removed from the internal flow passage 130 when no longer necessary. Therefore, the flow restrictor 90 can be a plug that prevents fluid flow through the internal flow passage 130.

The flow restrictor example in FIG. 7 is retained in the flow passage 130 by shear structures 128, which can be shear pins, shear threads, etc. When the flow restrictor 90 is no longer necessary, then the pressure P1 can be increased at the inlet 132 past a predetermined level, such that the predetermined level can create a pressure differential across the flow restrictor 90 that will shear the shear structures 128 and eject the flow restrictor 90 from the internal flow passage 130 into the wellbore. It is preferable that the flow restrictor 90 be made of a material that will degrade over time to particles small enough that would not cause problems for future wellbore operations. The flow restrictor 90 can be removed from the internal flow passage 130 by shearing the shear structure 128, disintegration of the flow restrictor 90, dispersion of the flow restrictor 90, degradation of the flow restrictor 90, and combinations thereof. Disintegration can be performed by fracturing the flow restrictor 90 into smaller pieces, such as when the flow restrictor 90 is made from a polylactic acid (PLA) or polyglycolic acid (PGA), which can fracture at a predetermined pressure differential. Degradation can be performed by erosion of the flow restrictor 90, such as by flowing sand laden fluid (or other abrasive fluid) through the flow restrictor 90. Dissolution of the flow restrictor 90 can occur by flowing an acid or other caustic material to the flow restrictor 90 that reacts with the caustic material to dissolve the flow restrictor 90. Dispersion of the flow restrictor 90 can occur when the flow restrictor 90 is fractured into small pieces and the small pieces are dispersed from the internal flow passage 130 into the wellbore. Dispersion can also occur when the flow restrictor is a particle filled container positioned in the internal flow passage 130. The particle filled container can permit fluid flow through the particles (such as a filter) or prevent fluid flow. Increased pressure and/or a caustic material can cause the container to degrade, thereby releasing the particles from the container and from the inflatable deflector tool 80. The remaining container material can be further degraded and/or dispersed in to the wellbore.

The inflatable bladder 84 can be inflated when a pressure differential across the inflatable deflector tool 80 is created. When fluid flow 94 enters the internal flow passage 130 via inlet 132 at a pressure P1, a smaller fluid flow 96 can exit the flow restrictor 90 at a reduced pressure P2, thereby creating a pressure differential (P1−P2) across the inflatable deflector tool 80. The pressure differential (P1−P2) is also present across the bladder 84, which can cause a fluid flow 98 through the port 88 in the body 82, thereby filling a space between the bladder 84 and a portion of the body 82. The amount of inflation can depend upon the pressure differential (P1−P2) created across the inflatable deflector tool 80. Please note that multiple ports 88 and multiple bladders 84 can be used to increase a radial force used to push the inflatable deflector tool 80 away from the wall 13 of the main wellbore 12*a*. Also, a rupture disk or plug can be installed in the port 88 to initially prevent fluid flow through the port and thereby prevent inflation of the bladder 84. Increased pressure in the internal flow passage 130 can rupture the rupture disk and/or eject the plug to allow fluid flow through the port 88. The plug can also be removed via increased temperature (such as with wax) or reacting with a caustic material (such as acid). When the inflatable bladder 84 is inflated, it may contact the main wellbore wall 13. Therefore, when the tubing string 80 is extended into the main wellbore 12*a*, and the bladder 84 is inflated, friction between a surface 85 of the bladder 84 can work to resist movement of the tubing string 60. It may be desirable to reduce this friction by treating the bladder 84 (at least the surface 85) with a material (e.g. Teflon) that can reduce the friction between the bladder 84 and the wellbore wall 13. Also, other material, which can act to reduce the friction, can be positioned between the surface 85 and the main wellbore wall 13.

Figure 8:
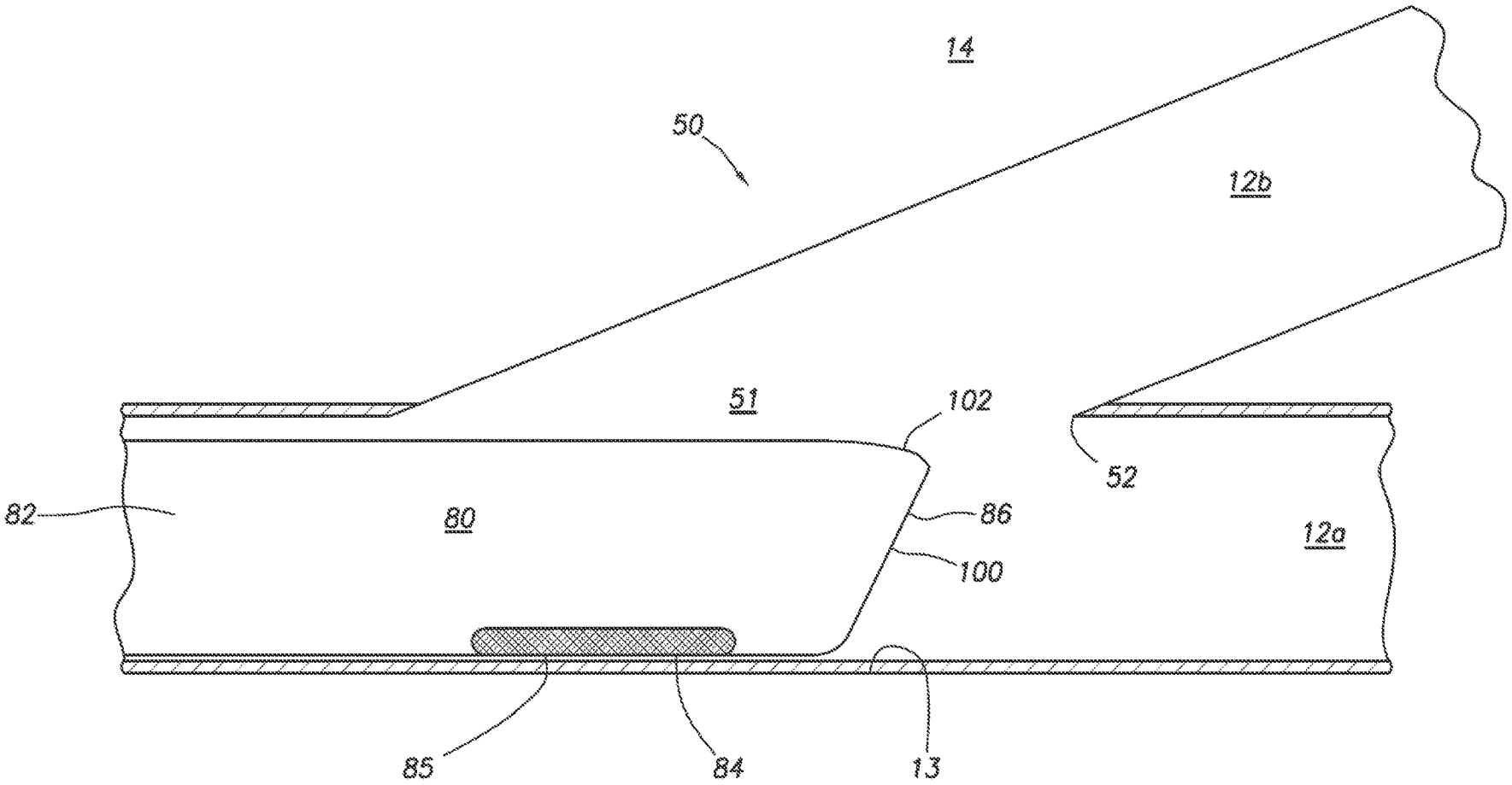
FIGS. 8-11 are representative partial cross-sectional views of the inflatable deflector tool of FIGS. 6A-C at various positions in the main wellbore, according to one or more example embodiments.
Figure 9:
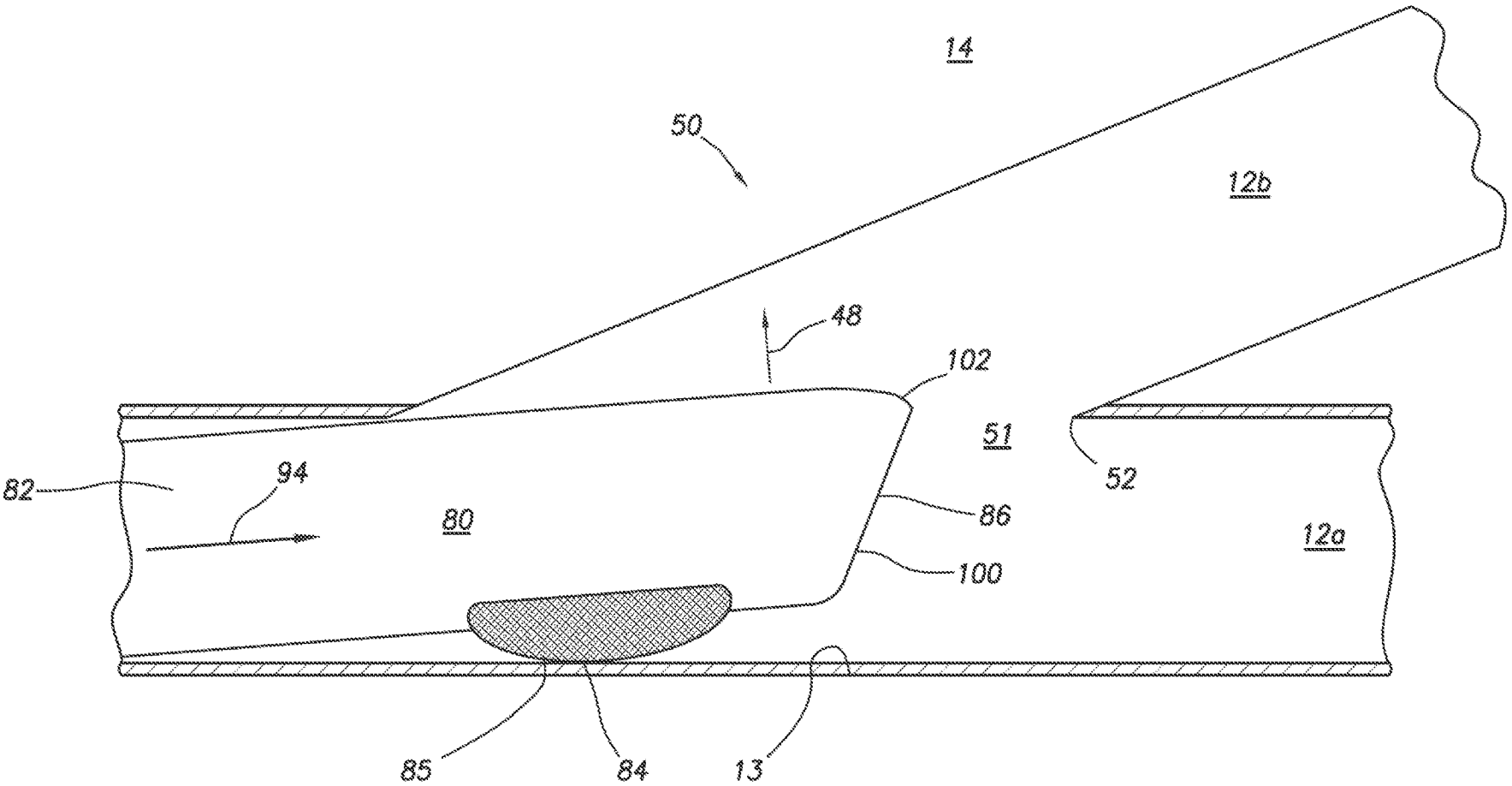
Figure 10:
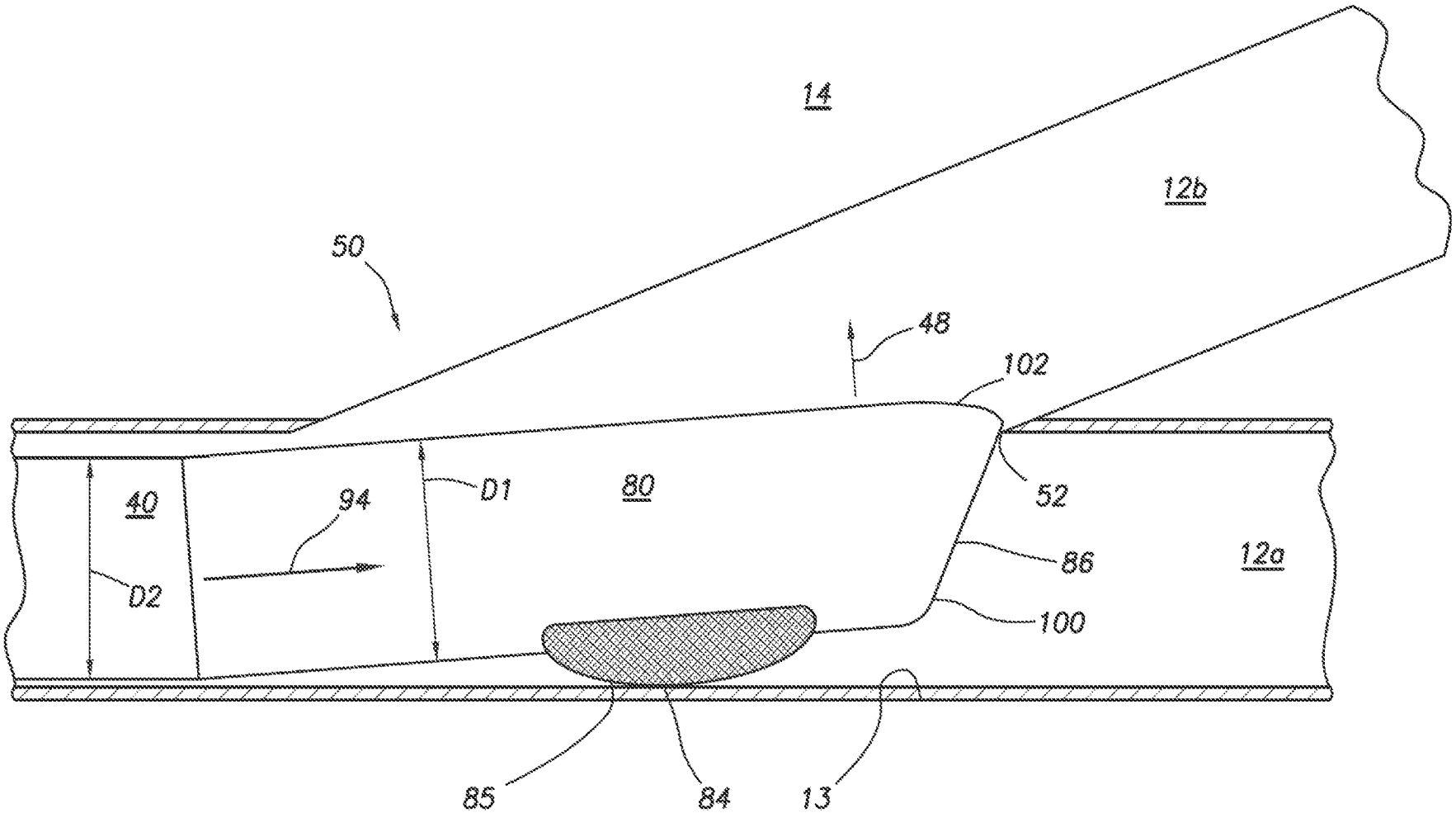
Figure 11:
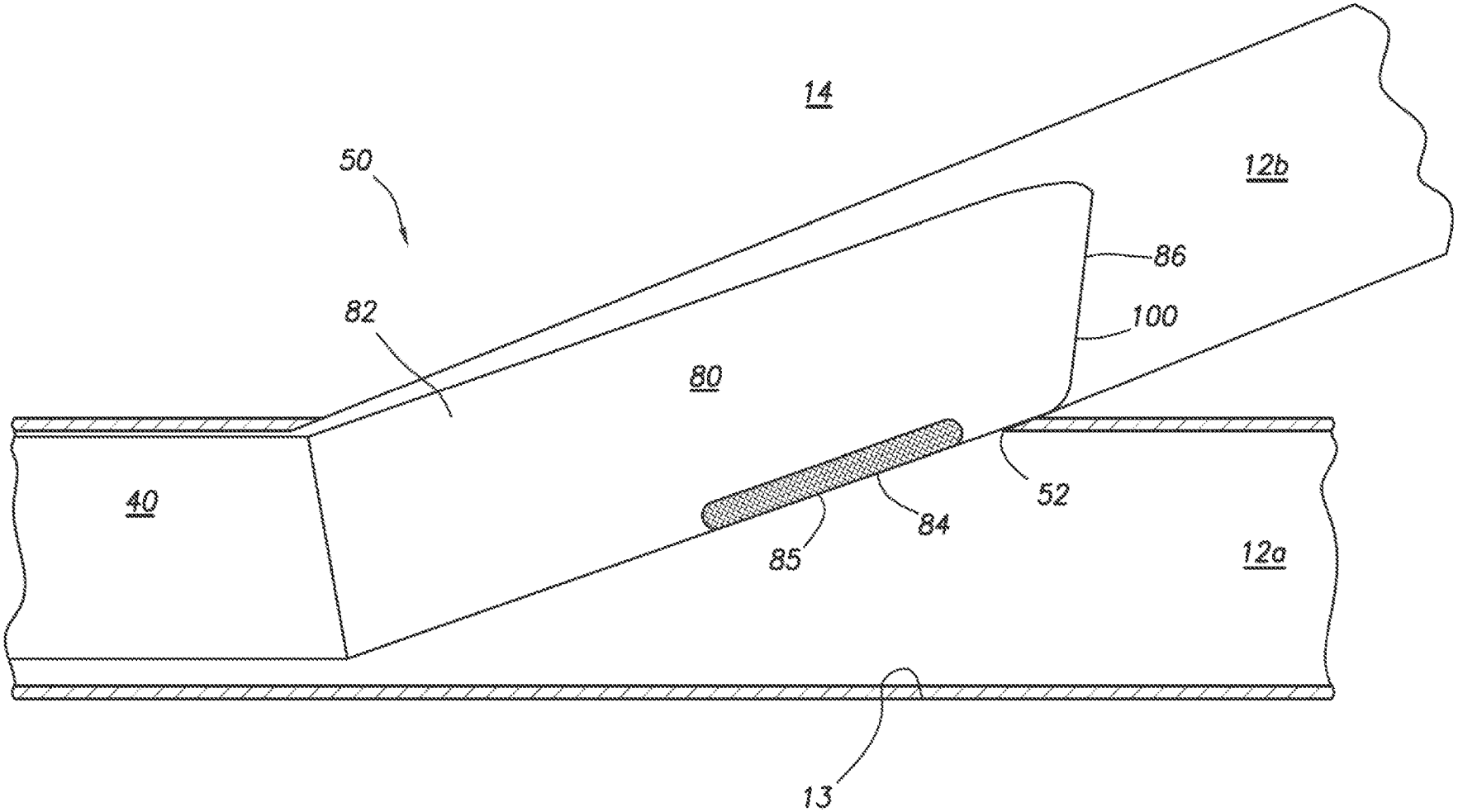

FIGS. 8-11 illustrate an example sequence of using the inflatable deflector tool 80 to deflect the tubing string 60 into the lateral wellbore 12*b*. When the inflatable deflector tool 80 is attached to a distal end of the tubing string 60, which in this example is again the straddle structure 40, the tool 80 can be extended into the main wellbore 12*a* until it is adjacent the window 51 at the intersection 50 (FIG. 8). The fluid flow 94 in the internal flow passage 130 can be increased causing a pressure differential across the inflatable deflector tool 80, thereby inflating the bladder 84 (FIG. 9). The inflation of the bladder 84 can push the inflatable deflector tool 80 away from the wall 13 and toward the window 51 (arrow 48). Maintaining the fluid flow 94, thereby maintaining the radial extension of the bladder 84, the tubing string 60 (along with the straddle structure 40) can be further extended into the main wellbore 12*a* causing the inclined surface 100 of the nose 86 to engage the bottom 52 of the window 51 (FIG. 10). As the tubing string 60 is further extended into the main wellbore 12*a*, the inclined surface 100 causes the inflatable deflector tool 80 to be further deflected into the lateral wellbore 12*b*. When the inflatable deflector tool 80 is fully deflected into the lateral wellbore 12*b*, the fluid flow 94 can be stopped, or at least reduced, to cause the bladder 84 to deflate. Further extension of the tubing string 60 in to the main wellbore 12*a* will then cause the inflatable deflector tool 80 to be further extended into the lateral wellbore 12*b*, thereby also extending the tubing string 60 into the lateral wellbore 12*b* (FIG. 11).

FIGS. 12A-15B show various additional configurations of the inflatable deflector tool 80. It should be understood that any of the features of these inflatable deflector tool 80 configurations can be used with any of the other features of the other inflatable deflector tool 80 configurations described in this disclosure, and any configuration of the inflatable deflector tool 80 described in this disclosure can be used as a substitute for any other inflatable deflector tool 80 described in this disclosure.

Figure 12A:
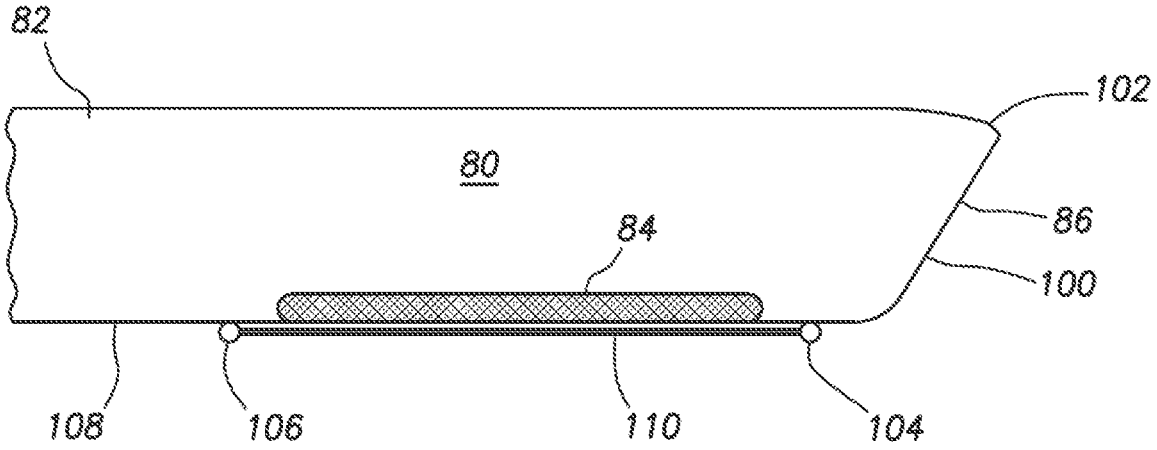
FIGS. 12A-B are representative side views of an inflatable deflector tool, according to one or more example embodiments.
Figure 12B:
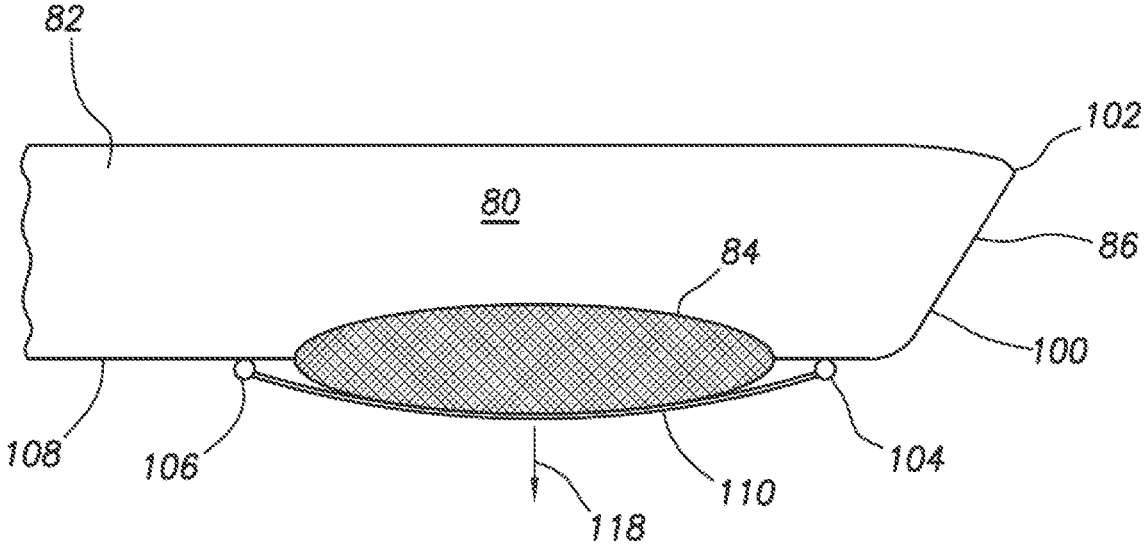

FIG. 12A shows a representative view of an inflatable deflector tool 80 with a lipstick-shaped nose 86. The bladder 84 is attached to the exterior surface 108 of the body 82 with an extendible arm 110 positioned over the bladder 84 with its ends 104 and 106 attached to the exterior surface 108. When the bladder 84 is inflated, it can radially extend (see arrow 118) the extendible arm 110 (FIG. 12B). The extendible arm 110 can be a plastic or metal (or combination) band that can elastically expand when the bladder 84 inflates and then contract when the bladder 84 deflates. The extendible arm 110 can provide reduced friction when sliding along a wellbore wall.

Figure 13A:
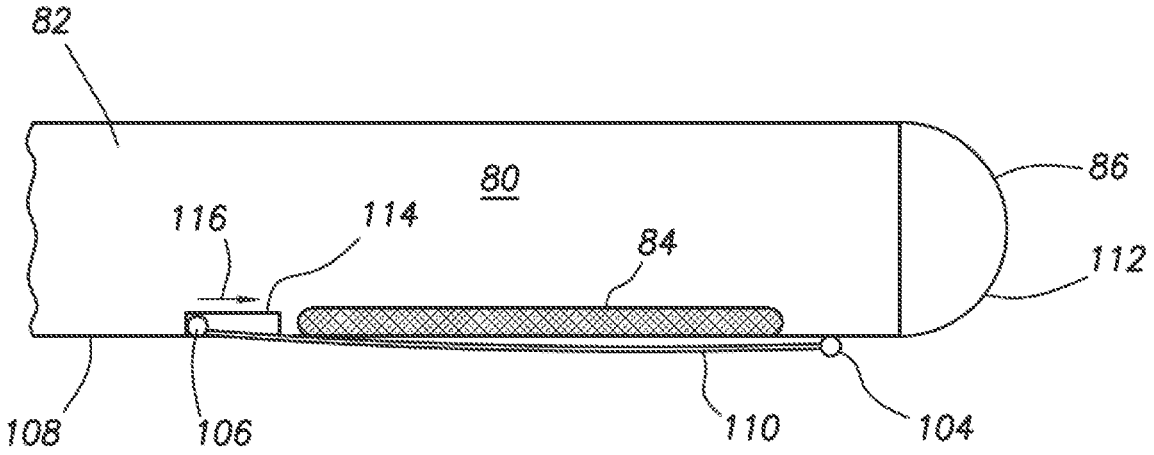
FIGS. 13A-B are representative side views of an inflatable deflector tool, according to one or more example embodiments.
Figure 13B:
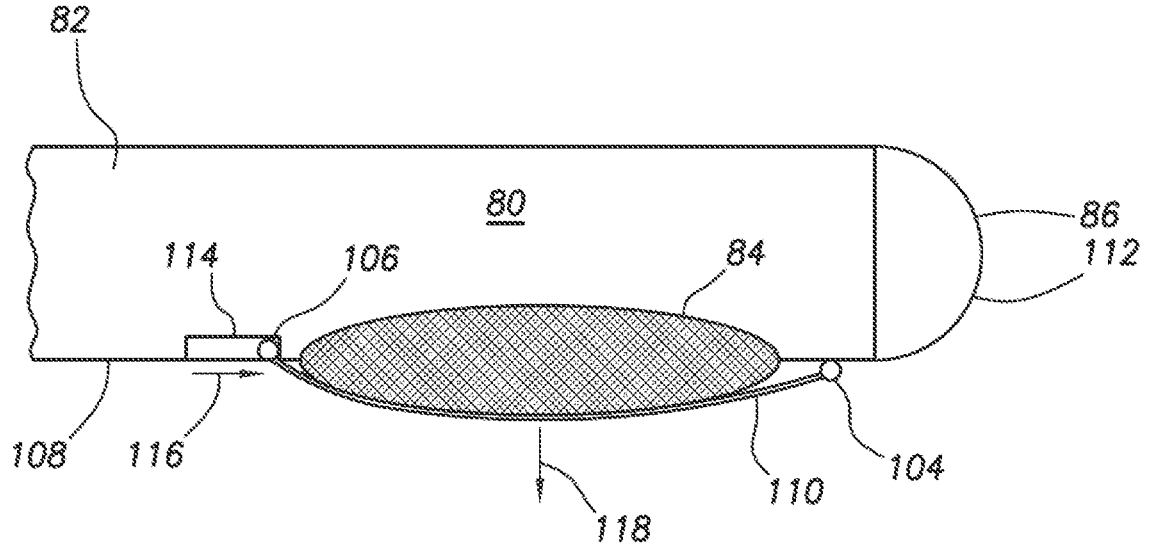

FIG. 13A shows a representative view of an inflatable deflector tool 80 with a spherically-shaped nose 86. The bladder 84 must push away from the main wellbore wall 13 enough to get the center of the spherically-shaped nose 86 past the bottom 52 of the window 51, so the spherical shape 112 can successfully further urge the inflatable deflector tool 80 into the lateral wellbore 12*b*. In this configuration, an extendible arm 110 can be attached to the exterior surface 108 at the end 104, with the end 106 being slidingly attached to the exterior surface 108 in slot 114. When the bladder 84 is inflated, it can radially extend (see arrow 118) the extendible arm 110 (FIG. 13B). The extendible arm 110 can be a plastic or metal (or combination) band that can flex when the bladder 84 inflates causing the end 106 to slide in the slot 114 (arrow 116) and then return to a semi-flat position when the bladder 84 deflates. The extendible arm 110 can provide reduced friction when sliding along a wellbore wall. When it is desirable to remove the flow restrictor 90, which can be the nose 86 in this configuration, the pressure can be increased to a predetermined level to release and/or fracture the nose 86 and eject it from the tool 80.

Figure 14A:
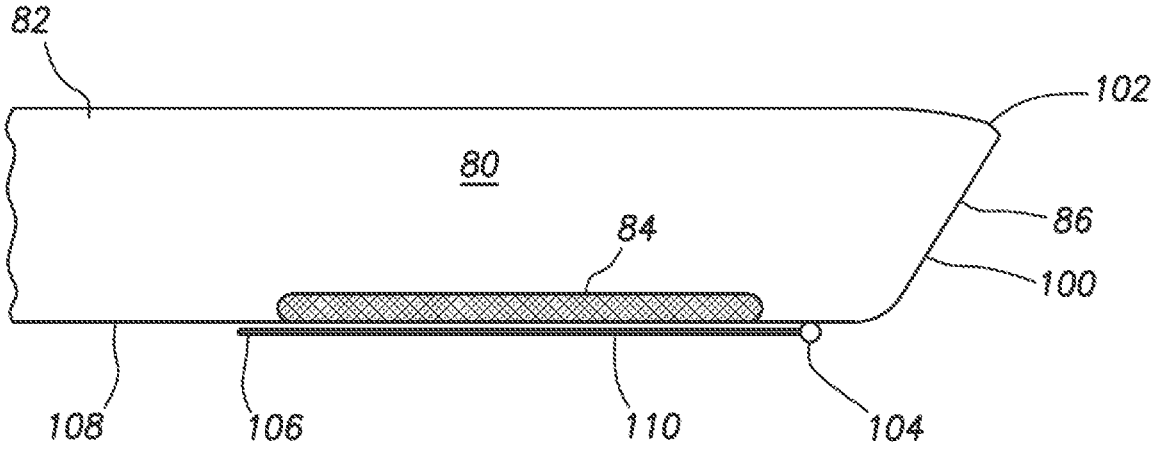
FIGS. 14A-B are representative side views of an inflatable deflector tool, according to one or more example embodiments.
Figure 14B:
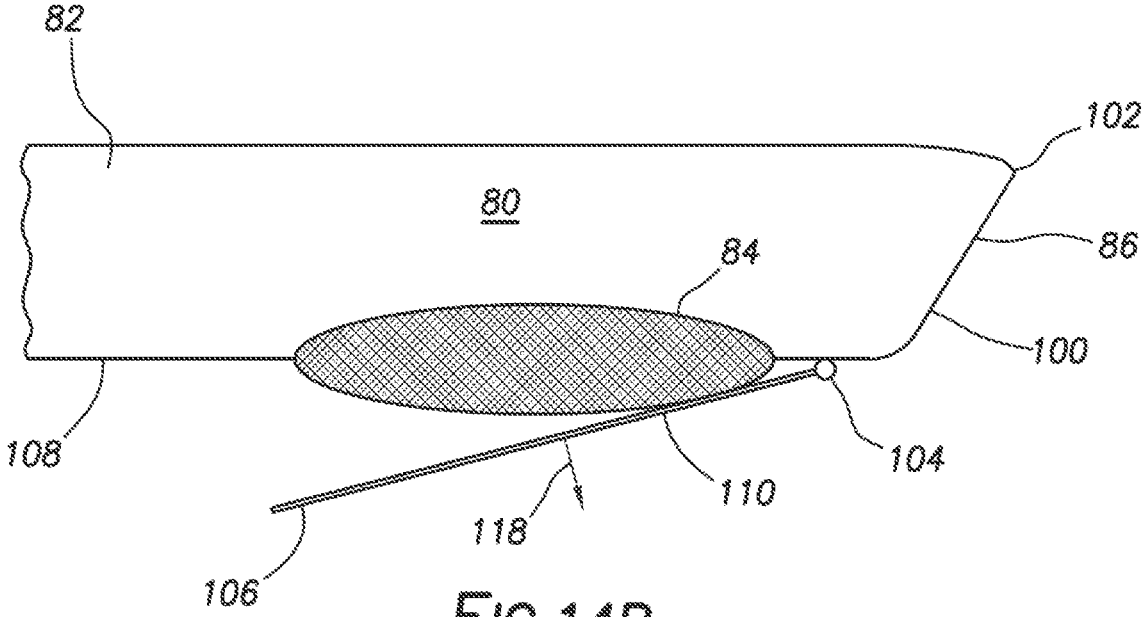

FIG. 14A shows a representative view of an inflatable deflector tool 80 with a lipstick-shaped nose 86. In this configuration, an extendible arm 110 can be attached to the exterior surface 108 at the end 104, with the end 106 not attached to the exterior surface 108. When the bladder 84 is inflated, it can radially extend (see arrow 118) and rotate (or pivot) the extendible arm 110 about the end 104 (FIG. 13B). The extendible arm 110 can be plastic or metal (or combination) that does not necessarily flex when the bladder 84 inflates causing the end 106 to extend, thereby pushing the inflatable deflector tool 80 away from the wall 13 and then returning to a semi-flat position when the bladder 84 deflates. The extendible arm 110 can provide reduced friction when sliding along a wellbore wall.

Figure 15A:
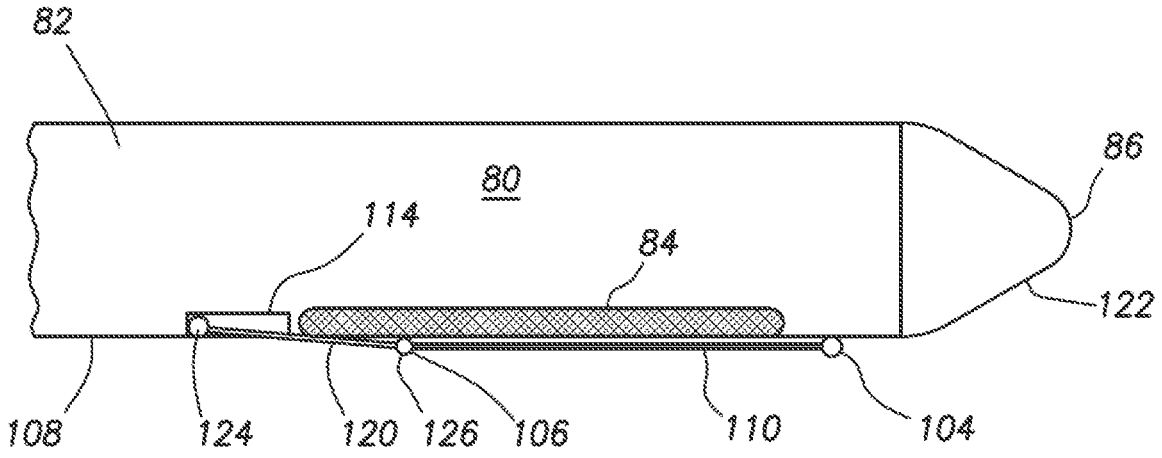
FIGS. 15A-B are representative side views of an inflatable deflector tool, according to one or more example embodiments.
Figure 15B:
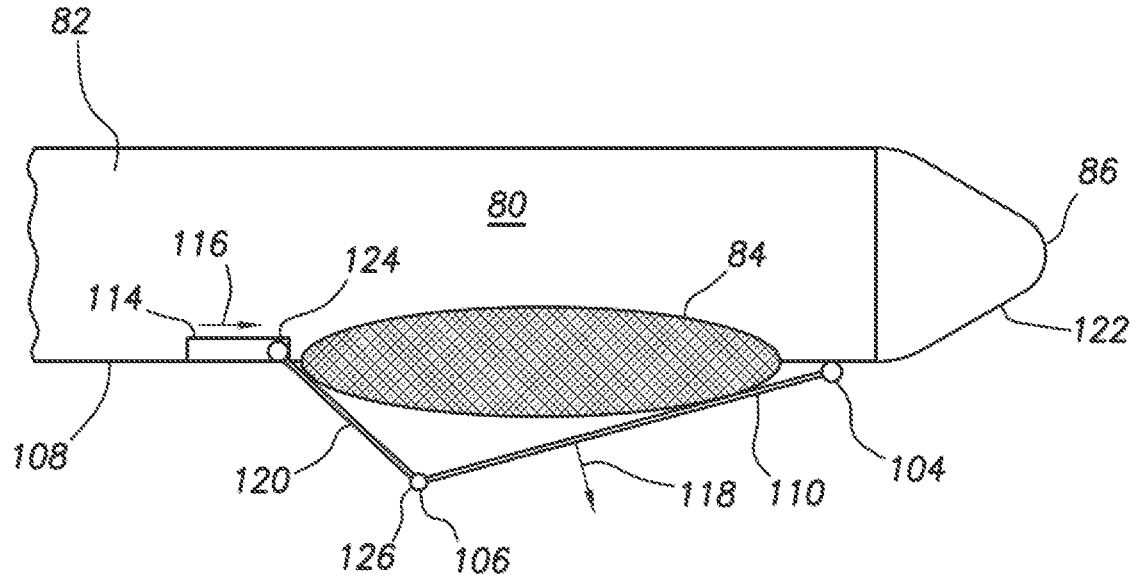

FIG. 15A shows a representative view of an inflatable deflector tool 80 with a conical-shaped nose 86. The bladder 84 must push away from the main wellbore wall 13 enough to get the center of the conically-shaped nose 86 past the bottom 52 of the window 51, so the incline of the conical shape 122 can successfully further urge the inflatable deflector tool 80 into the lateral wellbore 12*b*. In this configuration, an extendible arm can include two segments 110 and 120. An end 104 of the segment 110 can be pivotally attached to the exterior surface 108, with the end 106 being attached to an end 126 of the segment 120 and an end 124 of the segment 120 can be slidingly attached to the exterior surface 108 in slot 114. When the bladder 84 is inflated, it can radially extend (see arrow 118) the segmented 110, 120 extendible arm causing the pivotally connected ends 106 and 126 to push away from the wall 13 (FIG. 15B). The extendible arm segments 110, 120 can be plastic or metal (or combination) that does not necessarily flex when the bladder 84 inflates causing the end 126 to slide in the slot 114 (arrow 116) and then return to a semi-flat position when the bladder 84 deflates. The extendible arm segments 110, 120 can provide reduced friction when sliding along a wellbore wall.

Thus, an inflatable deflector tool 80 for reentry access into a lateral wellbore 12*b* is provided. The tool 80 can include a body 82 with an internal flow passage 130, an inflatable bladder 84 disposed along an exterior portion of the body 82, and a flow restrictor 90 that can partially restrict fluid flow through the internal flow passage 130. The flow restrictor 90 can create a pressure differential across the tool 80 when fluid pressure P1 rises at an inlet 132 of the internal flow passage 130. The pressure differential (P2–P1) can cause inflation of the inflatable bladder 84 and a surface 85 of the inflatable bladder 84 can be extended radially outward from the body 82 in response to the inflation. The extended surface 85 can push the tool 80 away from a wall 13 of a main wellbore 12*a* toward an opposite wall 15 of the main wellbore 12*a* and divert the tool 80 into a lateral wellbore 12*b*.

For any of the foregoing embodiments, the tool 80 may include any one of the following elements, alone or in combination with each other:

The tool 80 can also include a cylindrical body 82 with a nose 86 that has a shape selected from a group consisting of a lipstick shape, a conical shape, and a spherical shape. The flow restrictor 90 can be removed by causing a failure of a shear structure 128, disintegration of the flow restrictor 90, dispersion of the flow restrictor 90, degradation of the flow restrictor 90, and combinations thereof. The tool 80 can be attached to a distal end of a tubing string 60 and the tool 80 can divert the distal end of the tubing string 60 into the lateral wellbore 12*b*. An outer diameter of the tool 80 can be smaller than an outer diameter of the tubing string 60. The tool 80 can be extended past a polished bore receptacle (PBR) 62 in an upper end of a lower completion string 66*b* in the lateral wellbore 12*b*, with the tool 80 positioned in the lower completion string 66*b* below the PBR 62 and the tubing string 60 sealingly engaging the PBR 62.

The inflatable bladder 84 can be treated with a chemical that reduces friction between the surface 85 of the inflatable bladder 84 and the wall of the main wellbore 12*a*. The inflation of the inflatable bladder 84 can radially extend an extendable arm 110, and displace the tool 80 away from the main wellbore 12*a* wall. The extendable arm 110 can be selected from a group consisting of a plastic band, a metal band, a metal structure, and a multiple-segmented metal structure. The extendable arm 110 can include at least first and second ends 104, 106, with the first end 104 attached to the tool 80 at an attachment point. Inflation of the inflatable bladder 84 can cause the first end 104 to pivot about the attachment point (or the extendable arm to pivot about the first end 104).

A unitary junction assembly 38 can be attached to a distal end of a tubing string 60. The unitary junction assembly 38 can include a primary leg 39*a*, configured to engage a first lower completion string 66*a* in the main wellbore 12*a*, and a lateral leg 39*b*, configured to engage a second lower completion string 66*b* in the lateral wellbore 12*b*, with the inflatable deflector tool 80 attached to a distal end of the lateral leg 39*b*.

The inflation of the inflatable bladder 84 can push the lateral leg 39*b* away from the primary leg 39*a*, thereby directing the lateral leg 39*b* into the lateral wellbore 12*b* and the primary leg 39*a* into the main wellbore 12*a*.

A method for reentering a lateral wellbore 12*b* is provided, which can include operations of attaching an inflatable deflector tool 80 to a distal end of a tubing string 60, where the tool 80 can include a body 82 with an internal flow passage 130, an inflatable bladder 84 attached to a portion of the exterior 108 of the body 82, and a flow restrictor 90 that at least partially restricts fluid flow 94 through the internal flow passage 130.

The operations can also include positioning the inflatable deflector tool 80 proximate and above an intersection 50 of a lateral wellbore 12*b* by extending the tubing string 60 through a main wellbore 12*a*, increasing fluid pressure P1 in the tubing string 60, thereby inflating the inflatable bladder 84, pushing the inflatable deflection tool 80 away from a wall 13 of the main wellbore 12*a* and toward an opposite wall 15 of the main wellbore 12*a* in response to the inflating, and further extending the tubing string 60 into the main wellbore 12*a*, with the inflatable deflector tool 80 entering the lateral wellbore 12*b*.

For any of the foregoing embodiments, the method may include any one of the following operations, alone or in combination with each other:

The operations can include decreasing fluid pressure P1 in the tubing string 60, thereby deflating the inflatable bladder 84, further extending the tubing string 60 into the lateral wellbore 12*b*, thereby extending the inflatable deflector tool 80 into a lower completion string 66*b* and past a polished bore receptacle (PBR) 62 at a proximal end of the lower completion string 66*b*, and sealingly engaging the PBR 62 with seals 46 disposed at the distal end of the tubing string 60;

The operations can also include fracturing one or more intervals 72*a-c*, in the lateral wellbore 12*b*, injecting treatment fluid into the one or more intervals 72*a-c*; and/or producing fluid from the one or more intervals 72*a-c*. Removing the flow restrictor 90 from the inflatable deflector tool 80 by shearing at least one shear structure 128 by increasing the fluid pressure P1 in the tubing string 60 above a predetermined level and ejecting the flow restrictor 90 from the tool 80, disintegrating the flow restrictor 90, dispersing the flow restrictor 90, degrading the flow restrictor 90, or combinations thereof.

The operations can also include decreasing fluid pressure P1 in the tubing string 60, thereby deflating the inflatable bladder 84, further extending the tubing string 60 into the lateral wellbore 12*b*, thereby extending the inflatable deflector tool 80 into a casing string 58 in the lateral wellbore 12*b*; and setting a packer 42 positioned in the main wellbore 12*a* near the distal end of the tubing string 60, thereby sealingly engaging the main wellbore 12*a*. The distal end of the tubing string 60 can include a unitary junction assembly 38 attached thereto, the unitary junction assembly 38 can include a primary leg 39*a*, configured to engage a first lower completion string 66*a* in the main wellbore 12*a*, and a lateral leg 39*b*, configured to engage a second lower completion string 66*b* in the lateral wellbore 12*b*, with the inflatable deflector tool 80 attached to a distal end of the lateral leg 39*b*. Inflating the inflatable bladder 84 can push the lateral leg 39*b* away from the primary leg 39*a*, thereby directing the lateral leg 39*b* into the lateral wellbore 12*b* and the primary leg 39*a* into the main wellbore 12*a*.

The operations can also include an inflatable deflector tool 80 with an extendable arm 110, where inflation of the inflatable bladder 84 can radially extend the extendable arm 110, and displace the tool 80 away from the main wellbore 12*a* wall. The extendable arm 110 can be a plastic band, a metal band, a metal structure, and/or a multiple-segmented metal structure. The extendable arm 110 can include at least first and second ends 104, 106, with the first end 104 is attached to the tool 80 at an attachment point, with the inflation of the inflatable bladder 84 pivoting the first end 104 about the attachment point.

A system for reentry access into a lateral wellbore 12*b* is provided, which can include a tubing string 60, and an inflatable deflector tool 80 attached to a distal end of the tubing string 60. The tool 80 can include a body 82 with an internal flow passage 130, an inflatable bladder 84 disposed along an exterior portion of the body 82, and a flow restrictor 90 that restricts fluid flow through the internal flow passage 130.

A pressure source 78 (also referred to as a pump) can be fluidicly coupled to the tubing string 60. The pressure source 78 can increase pressure P1 in the tubing string 60 and create a pressure differential (P2–P1) across the tool 80 due to the flow restrictor 90. The pressure differential (P2–P1) can cause inflation of the inflatable bladder 84 and a surface 85 of the inflatable bladder 84 can be extended radially outward from the body 82 in response to the inflation. The extended surface 85 can push the tool 80 away from a wall 13 of a main wellbore 12*a* toward an opposite wall 15 of the main wellbore 12*a* and divert the tool 80 into a lateral wellbore 12*b*.

For any of the foregoing embodiments, the system may include any one of the following elements, alone or in combination with each other:

The system can also include a removable flow restrictor 90 that can be removed by failure of a shear structure 128, disintegration of the flow restrictor 90, dispersion of the flow restrictor 90, degradation of the flow restrictor 90, and combinations thereof. The tool 80 can also include an extendable arm 110, where inflation of the inflatable bladder 84 can radially extend the extendable arm 110, and displace the tool 80 away from the main wellbore 12*a* wall 13.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

The invention claimed is:

1. An inflatable deflector tool for reentry access into a lateral wellbore, the tool comprising:

a body with an internal flow passage;

an inflatable bladder disposed along an exterior portion of the body; and a flow restrictor that at least partially restricts fluid flow through the internal flow passage and creates a pressure differential across the tool when fluid pressure rises at an inlet of the internal flow passage, wherein the pressure differential causes inflation of the inflatable bladder and a surface of the inflatable bladder is extended radially outward from the body in response to the inflation, and wherein the extended surface pushes the tool away from a wall of a main wellbore toward an opposite wall of the main wellbore and diverts the tool into a lateral wellbore;

wherein the flow restrictor is removable, and wherein the flow restrictor is removed by one of the group consisting of failure of a shear structure, disintegration of the flow restrictor, dispersion of the flow restrictor, degradation of the flow restrictor, and combinations thereof.

2. The tool of claim 1, wherein the body is a cylindrical body with a nose that has a shape selected from a group consisting of a lipstick shape, a conical shape, and a spherical shape.

3. The tool of claim 1, wherein the tool is attached to a distal end of a tubing string and the tool diverts the distal end of the tubing string into the lateral wellbore.

4. The tool of claim 3, wherein an outer diameter of the tool is smaller than an outer diameter of the tubing string, wherein the tool is extended past a polished bore receptacle (PBR) in an upper end of a lower completion string in the lateral wellbore, and wherein the tool positioned in the lower completion string below the PBR with the tubing string sealingly engages the PBR.

5. The tool of claim 1, wherein the inflatable bladder is treated with a chemical that reduces friction between the surface of the inflatable bladder and the wall of the main wellbore.

6. The tool of claim 1, further comprising an extendable arm, wherein the inflation of the inflatable bladder radially extends the extendable arm, and displaces the tool away from the main wellbore wall.

7. The tool of claim 6, wherein the extendable arm is selected from a group consisting of a plastic band, a metal band, a metal structure, and a multiple-segmented metal structure.

8. The tool of claim 6, wherein the extendable arm comprises at least first and second ends, and the first end is attached to the tool at an attachment point, and wherein the inflation of the inflatable bladder pivots the first end about the attachment point.

9. The tool of claim 1, wherein a unitary junction assembly is attached to a distal end of a tubing string, wherein the unitary junction assembly comprises a primary leg, configured to engage a first lower completion string in the main wellbore, and a lateral leg, configured to engage a second lower completion string in the lateral wellbore, and wherein the inflatable deflector tool is attached to a distal end of the lateral leg.

10. The tool of claim 9, wherein the inflation of the inflatable bladder pushes the lateral leg away from the primary leg, thereby directing the lateral leg into the lateral wellbore and the primary leg into the main wellbore.

11. A method for reentering a lateral wellbore, the method comprising:

attaching an inflatable deflector tool to a distal end of a tubing string, the tool comprising;

a body with an internal flow passage, an inflatable bladder attached to an exterior portion of the body, and a flow restrictor that at least partially restricts fluid flow through the internal flow passage;

positioning the inflatable deflector tool proximate and above an intersection of a lateral wellbore by extending the tubing string through a main wellbore;

increasing fluid pressure in the tubing string, thereby inflating the inflatable bladder;

pushing the inflatable deflection tool away from a wall of the main wellbore and toward an opposite wall of the main wellbore in response to the inflating;

further extending the tubing string into the main wellbore, with the inflatable deflector tool entering the lateral wellbore; and removing the flow restrictor from the inflatable deflector tool, wherein the removing is performed by an operation selected from a group consisting of:

shearing at least one shear structure by increasing the fluid pressure in the tubing string above a predetermined level and ejecting the flow restrictor from the tool, disintegrating the flow restrictor, dispersing the flow restrictor, degrading the flow restrictor, and combinations thereof.

12. The method of claim 11, further comprising:

decreasing fluid pressure in the tubing string, thereby deflating the inflatable bladder;

further extending the tubing string into the lateral wellbore, thereby extending the inflatable deflector tool into a lower completion string and past a polished bore receptacle (PBR) at a proximal end of the lower completion string; and sealingly engaging the PBR with seals disposed at the distal end of the tubing string.

13. The method of claim 12, further comprising:

fracturing one or more intervals in the lateral wellbore;

injecting treatment fluid into the one or more intervals; or producing fluid from the one or more intervals.

14. The method of claim 11, further comprising:

decreasing fluid pressure in the tubing string, thereby deflating the inflatable bladder;

further extending the tubing string into the lateral wellbore, wherein the inflatable deflector tool extends into a casing string in the lateral wellbore; and setting a packer positioned in the main wellbore near the distal end of the tubing string, thereby sealingly engaging the main wellbore.

15. The method of claim 11, wherein the distal end of the tubing string includes a unitary junction assembly attached thereto, wherein the unitary junction assembly comprises a primary leg, configured to engage a first lower completion string in the main wellbore, and a lateral leg, configured to engage a second lower completion string in the lateral wellbore, and wherein the inflatable deflector tool is attached to a distal end of the lateral leg.

16. The method of claim 15, wherein the pushing the inflatable deflection tool away further comprises pushing the lateral leg away from the primary leg, thereby directing the lateral leg into the lateral wellbore and the primary leg into the main wellbore.

17. The method of claim 11, wherein the inflatable deflector tool further comprises an extendable arm, and wherein the inflation of the inflatable bladder radially extends the extendable arm, and displaces the tool away from the main wellbore wall.

18. The method of claim 17, wherein the extendable arm is selected from a group consisting of a plastic band, a metal band, a metal structure, and a multiple-segmented metal structure.

19. The method of claim 17, wherein the extendable arm comprises at least first and second ends, and the first end is attached to the tool at an attachment point, and wherein the inflation of the inflatable bladder pivots the first end about the attachment point.

20. A system for reentry access into a lateral wellbore, the system comprising:

a tubing string;

an inflatable deflector tool attached to a distal end of the tubing string, the tool comprising:

a body with an internal flow passage, an inflatable bladder disposed along an exterior portion of the body, and a flow restrictor that restricts fluid flow through the internal flow passage;

a pressure source fluidically coupled to the tubing string, wherein the pressure source increases pressure in the tubing string and creates a pressure differential across the tool due to the flow restrictor, wherein the pressure differential causes inflation of the inflatable bladder and a surface of the inflatable bladder is extended radially outward from the body in response to the inflation, and wherein the extended surface pushes the tool away from a wall of a main wellbore toward an opposite wall of the main wellbore and diverts the tool into a lateral wellbore;

wherein the flow restrictor is removable, and wherein the flow restrictor is removed by one of the group consisting of failure of a shear structure, disintegration of the flow restrictor, dispersion of the flow restrictor, degradation of the flow restrictor, and combinations thereof.

21. The system of claim 20, wherein the tool further comprising an extendable arm, wherein the inflation of the inflatable bladder radially extends the extendable arm, and displaces the tool away from the main wellbore wall.

* * * * *